US005950283A

United States Patent [19]

Sato

[11] Patent Number: 5,950,283

[45] Date of Patent: Sep. 14, 1999

[54] CLIP

[76] Inventor: Hisao Sato, Fujimidai Mansion 2002, 29-10, Nukui 1-chome, Nerima-ku, Tokyo, Japan

[21] Appl. No.: 08/921,380

[22] Filed: Aug. 29, 1997

[51] Int. Cl.[6] ..... B42F 1/02

[52] U.S. Cl. ..... 24/67 R; 24/67.5

[58] Field of Search ..... 24/67 R, 67.5, 24/67.3, 327, 67 CF, 326, 545, 546, 499, DIG. 8, DIG. 9, DIG. 10; D8/395; D19/86, 65

[56] References Cited

U.S. PATENT DOCUMENTS

| | | | |
|---|---|---|---|
| 3,286,381 | 11/1966 | Wooge | 24/67.5 X |
| 4,332,060 | 6/1982 | Sato | 24/67.5 X |
| 4,532,680 | 8/1985 | Hashimoto | 24/67.5 X |
| 4,696,081 | 9/1987 | Yen | 24/67.5 X |
| 4,735,438 | 4/1988 | Demarest, Jr. | 24/67.5 X |
| 4,761,862 | 8/1988 | Hiromori | 24/67.5 X |
| 4,910,907 | 3/1990 | Schlaegel | 43/44.6 |
| 5,404,622 | 4/1995 | Sato | 24/67 CF |
| 5,533,236 | 7/1996 | Tseng | 24/67 R X |

FOREIGN PATENT DOCUMENTS

| | | |
|---|---|---|
| 6-79580 | 11/1994 | Japan . |
| 7-31374 | 6/1995 | Japan . |
| 8-25866 | 1/1996 | Japan . |

*Primary Examiner*—Anthony Knight
*Assistant Examiner*—Robert J. Sandy
*Attorney, Agent, or Firm*—Kanesaka & Takeuchi

[57] ABSTRACT

A clip which is made from a band-like metal plate having spring characteristics, in which opening of the clip can be performed by a considerably weak force, in which setting is less even if sheets of paper having a stack thickness nearly equal to the maximum clipping thickness, and which comprises a body including a back portion formed at a longitudinal center portion of the band-like metal plate so as to have a length substantially corresponding to the maximum clipping thickness, and abutment portions formed adjacent to the back portion so that the respective free ends of the abutment portions form abutting edges which abut against each other for clipping sheets of paper; a pair of finger grips for opening the abutting edges of the abutment portions, the finger grips being attached to the abutment portions respectively in a manner so that each of the finger grips is formed into a U-shape and respective free ends of the U-shape of the finger grip are rotatably inserted into lock portions formed at each of the abutting edges of the abutment portions; at least three bent portions formed in the body for giving elastic forces to the abutment portions so as to make the abutting edges of the abutment portions elastically contact with each other; and an opening provided in a widthwise center portion of the back portion so that corner part of sheets of paper can be projected out of the opening, the opening being extended into the abutment portions.

7 Claims, 4 Drawing Sheets

CLIP

BACKGROUND OF THE INVENTION

1. Field of the Invention

The present invention relates to a clip for clipping sheets of paper, and particularly relates to a clip in which end portions abutting on each other are opened by a pair of finger grips to clip sheets of paper between these end portions.

2. Description of the Related Art

To clip loose sheets of paper, there has been used a clip called a double clip widely. This clip is constituted by a body made from a band-like elastic plate such as steel and a pair of finger grips attached to the body. The body has a back portion formed in a longitudinally central portion of the band-like metal plate so as to have a length substantially corresponding to a maximum clipping thickness of the clip, and abutment portions formed by bending the band-like metal plate in the same direction at the lengthwise opposite ends of the back portion so that the respective free ends of the abutment portions abut against each other elastically. The pair of finger grips are formed from hard metal wire, and the opposite ends of each of the finger grips are rotatably inserted into ring-like lock portions formed by bending the free end portion of each of the abutment portions. To clip a stack of sheets of paper or documents, one may grip and rotate the free ends of the two finger grips by fingers toward the back portion, that is, in the direction to make the free ends of the finger grips come close to thereby spread the nip between the respective free ends of the abutment portions to clip documents or the like in the nip.

Hereinafter, with respective to a clip, the term "length" means a size in the longitudinal direction of the band-like metal plate from which the clip is produced and the term "width" means a size in the widthwise direction perpendicular to the longitudinal direction of the band-like metal plate.

In such a clip, essential portions for clipping documents or the like are the free ends, that is, the abutting edges of the two abutment portions of the body. The width or widthwise size of each of the abutting edges corresponds to the width of the elastic metal plate. The elastic force acting on the abutting edges of the two abutment portions to make the abutting edges come close to each other is produced by bending the band-like metal plate at the borders between the back portion and the two abutment portions to make the abutting edges of the abutment portions abut against each other elastically. This clip body, when viewed from a side, forms an isosceles triangle having a base formed of the length of the back portion, and other two sides which are equal in length and formed of the abutment portions. In this case, if the band-like metal plate are bent at the two borders so that the abutting edges of the abutment portions abut against each other simply, the abutting edges of the abutment portions cannot abut against each other completely all over their width surely and the clip cannot clip a few thin sheets of paper firmly. Further, a clipping force is so weak that the clip cannot clip thick sheets of paper. Therefore, the back portion is curved inward and extended toward its ends along its width to thereby make the interior angles of the respective borders acute. With the interior angles made acute, a virtual intersection point at the abutting edges of the two abutment portions moves to a center portion of the triangle, so that the abutting edges of the abutment portions abut against each other tightly. Accordingly, the clip can clip thin sheets of paper. In addition, since the clipping force increases, the clip can clip thick sheets of paper surely. Therefore, although the normal isosceles triangle is formed so that the two interior angles at the borders are about 65° respectively by way of example, if the back portion is curved inward as mentioned above, the interior angles take, for example, about 40° to thereby generate a strong elastic force between the abutting edges of the two abutment portions. Although the value of these interior angles depends on the size of the clip, needless to say, it is necessary to make the two bending angles, that is, interior angles at the borders be not larger than 90°.

On the other hand, for example, JP-U-6-79580 and JP-U-7-31374 disclose a so-called corner clip in which an opening is formed substantially in a widthwise center portion of a back portion, so that corner parts of sheets of paper are be clipped is made to project outside through this opening so as to make the clip easily clip the corner part of the sheets of paper. Further, JP-U-8-28566 discloses a modification of the corner clip disclosed in the above JP-U-7-31374, in which the lengthwise edge of the opening is limited up to the borders between the back portion and the abutment portions to thereby prevent the abutting edges of the abutment portions from being loosened by the formed opening.

In the conventional clips, as mentioned above, the elastic force for making the abutting edges of the abutment portions abut against each other is generated by bending the band-like metal plate at the two borders between the back portion and the abutment portions. Further, the back portion is curved inward to make the interior angles of these bent portions smaller to thereby increase the elastic force of the respective abutment portions against each other. As a result, the elastic force having a value which is stronger than the required value is generated between the abutting edges of the abutment portions in the direction to make the abutting edges close to each other elastically. Accordingly, it is difficult to open the clip enough so that the abutment portions become parallel with each other when a stack of sheets of paper having a thickness which is near an allowable maximum thickness of the clip is clipped, and particularly in a large clip, a very strong force is required to open the clip. In addition, when the sheets of paper are once clipped, a strong clipping force is applied to the sheets of paper so that the sheets of paper are not removed from the clip even if the clipped sheets of paper are lifted up from the clip to give a strong shock to the sheets of paper at the clip. Accordingly, there is a case that stripe marks caused by the abutting edges of the abutment portions are left in the sheets of paper after the clip is removed from the sheets of paper.

However, when the clipped sheets of paper are to be handled, there is few case in which while the finger grips are gripped by fingers to handle the sheets, a strong shock is given to the sheets. Accordingly, it is requested to make the clipping force weaker so that the abutting edges of the abutment portions can be opened easily by a weaker force. The acuter the interior angles are, the stronger the elastic force becomes. Therefore, in this case, the elastic force can be reduced if the interior angles at the borders are increased. However, the abutting edges of the abutment portions are opened up to the interior angle or more when the abutting edges of the abutment portions are opened. When this operation is repeated, setting is caused at the bent portions, so that there is a fear that a gap is produced between the abutting edges of the abutment portions when the clip is opened after clipping thick sheets of paper for a long time, and thin sheets of paper may be detached easily when such thin sheets of paper are clipped next. In addition, in the corner clip disclosed in the above-mentioned JP-U-6-79580 or JP-U-7-31374, in which an opening is provided in a back portion, the elastic force is not reduced if the opening is provided only in the back portion. On the contrary, the above JP-U-8-25866 states that the elastic force is reduced corresponding to the opening if the borders between the back portion and the abutment portions are partly deleted by the opening, and the strength of the clip body is reduced and easily broken if the opening is further extended into the abutment portions. JP-U-8-25866 further states that in order to prevent this, therefore, it is necessary to limit the opening up to the borders between the back portion and the abutment portions. Accordingly, the opening in the back portion is only for making corner parts of sheets of paper project out therefrom, without any intention to reduce the elastic force by the effect of the opening so as to easily open the clip to make the abutment portions parallel with each other.

SUMMARY OF THE INVENTION

Taking such a foregoing actual situation of conventional techniques into consideration, it is a first object of the present invention to provide a clip which can be opened with a clip opening force smaller than that in the conventional one, and in which settling hardly occurs in the bent portions even if sheet-like members having a stack thickness near the maximum clipping thickness are clipped by the clip.

It is a second object of the present invention to provide a clip which can clip sheet-like members of a stack thickness near the maximum clipping thickness even if the clip is made from a metal plate low in spring characteristic, and in which abutment portions can return to their initial positions so that the abutting edges abut against each other tightly even after the sheet-like members are removed and the clip can be used repeatedly.

In order to achieve the above objects, according to a first aspect of the present invention, provided is a clip comprising: a body made from a band-like metal plate having spring characteristics, the body including a back portion formed at a longitudinal center portion of the band-like metal plate so as to have a length in a longitudinal direction of the band-like metal plate substantially corresponding to a maximum clipping thickness of the clip, and abutment portions formed by bending the band-like metal plate in the same direction at lengthwise opposite ends of the back portion so that respective free ends of the abutment portions form abutting edges which abut against each other for clipping sheets of paper between the abutting edges of the abutment portions; a pair of finger grips for opening the abutting edges of the abutment portions, the finger grips being attached to the abutment portions respectively in a manner so that each of the finger grips is formed into a U-shape and respective free ends of the U-shape of the finger grip are rotatably inserted into lock portions formed at each of the abutting edges of the abutment portions; at least three bent portions formed in the body for giving elastic forces to the abutment portions so as to make the abutting edges of the abutment portions elastically contact with each other; and an opening provided in a substantially widthwise center portion of the back portion so that corner part of sheets of paper to be clipped can be inserted into the opening so as to project out therefrom, the opening being extended into each of the abutment portions.

According to a second aspect of the present invention, in the above clip of the first aspect, the back portion is formed into a substantial trapezoid having first, second, third and fourth bent portions, the first and second bent portions being formed at borders between the lengthwise opposite ends of the back portions and the pair of abutment portions respectively, the third and fourth bent portions being formed at a distance therebetween substantially in a lengthwise center portion of the back portion.

According to a third aspect of the present invention, in the above clip of the first aspect, an interior angle of each of the third and fourth bent portions is obtuse.

According to a fourth aspect of the present invention, in the above clip of the first aspect, an interior angle of each of the third and fourth bent portions is more obtuse than an interior angle of each of the first and second bent portions.

According to a fifth aspect of the present invention, in the above clip of the second aspect, sides constituting the trapezoid are curved inward at least partially.

According to a sixth aspect of the present invention, in the above clip of the second aspect, a force to hold the sheets of paper is set by adjusting the interior angle of each of the third and fourth bent portions.

According to a seventh aspect of the present invention, in the above clip of the first aspect, a pair of leg portions of the U-shape of each of the finger grips is formed so as to be opposite to each other at a distance larger than a width of the opening of the back portion.

According to an eighth aspect of the present invention, in the above clip of the first aspect, the metal plate is made from stainless steel.

DETAILED DESCRIPTION OF THE PREFERRED EMBODIMENTS

Embodiments of the present invention will be described with reference to the accompanying drawings. In the following embodiments, parts substantially equivalent to each other are referenced correspondingly, and repeated description about these parts is omitted suitably.

Figure 1:
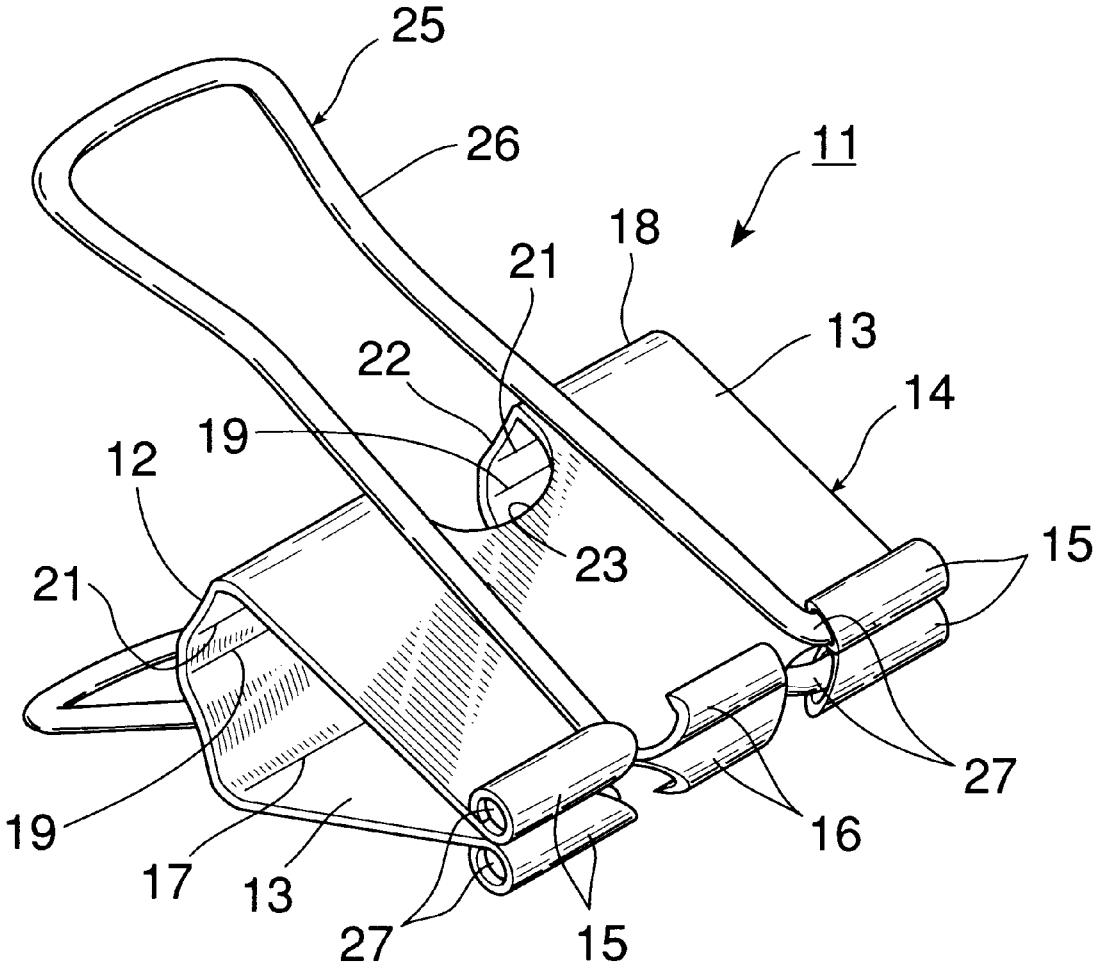
FIG. 1 is a perspective view illustrating a clip according to a first embodiment of the present invention.
Figure 2:
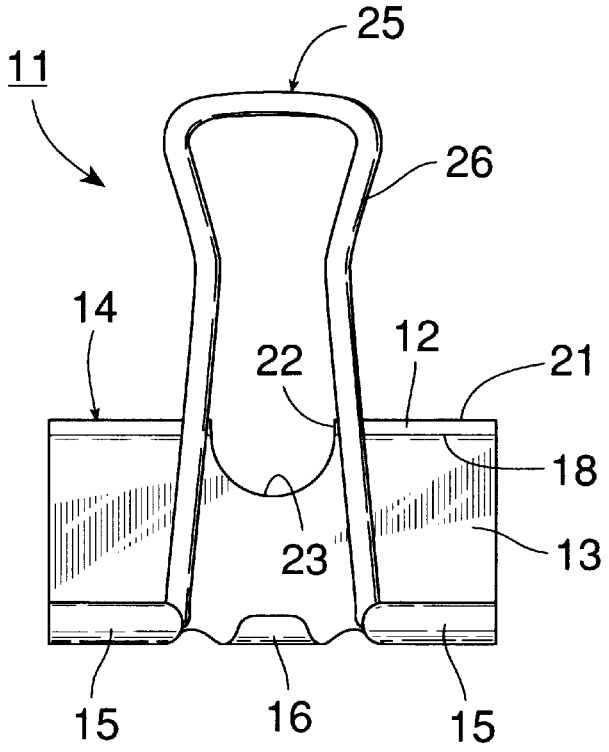
FIG. 2 is a plan view of the clip according to the first embodiment.
Figure 3:
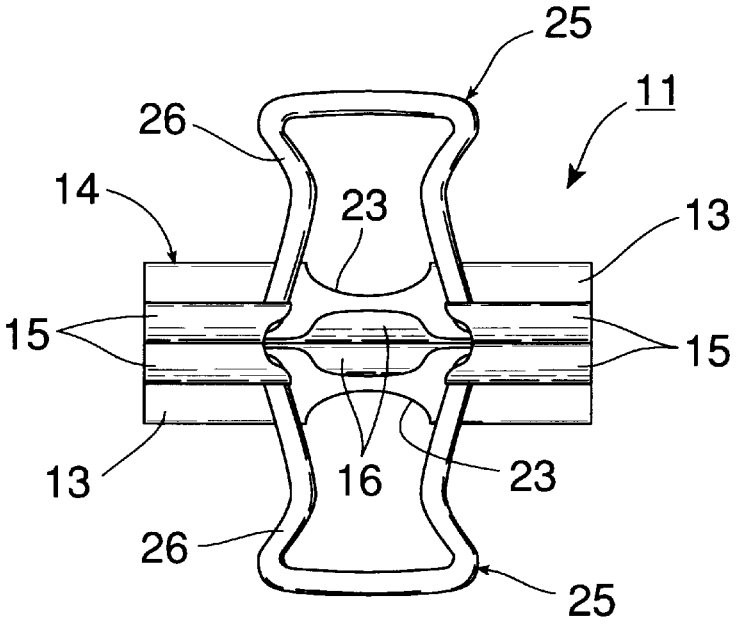
FIG. 3 is a bottom view of the clip according to the first embodiment.
Figure 4:
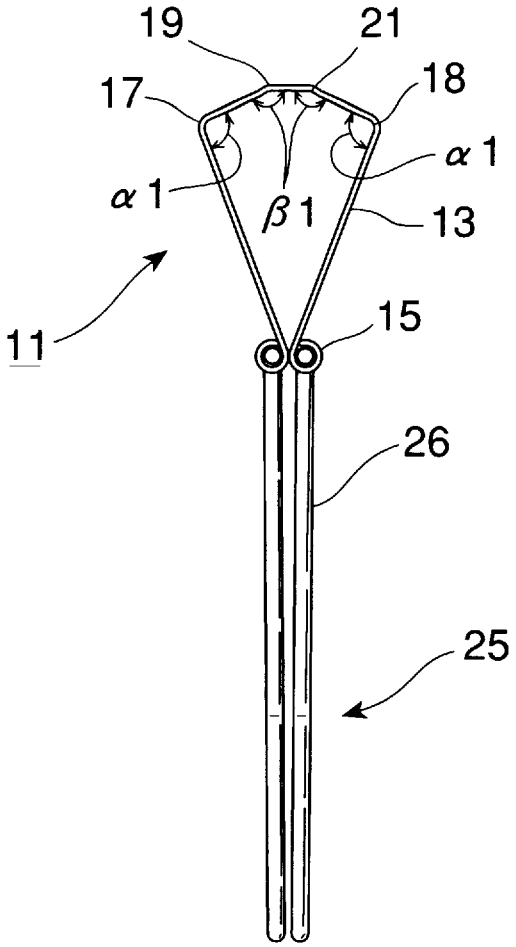
FIG. 4 is a side view of the clip according to the first embodiment.
Figure 5:
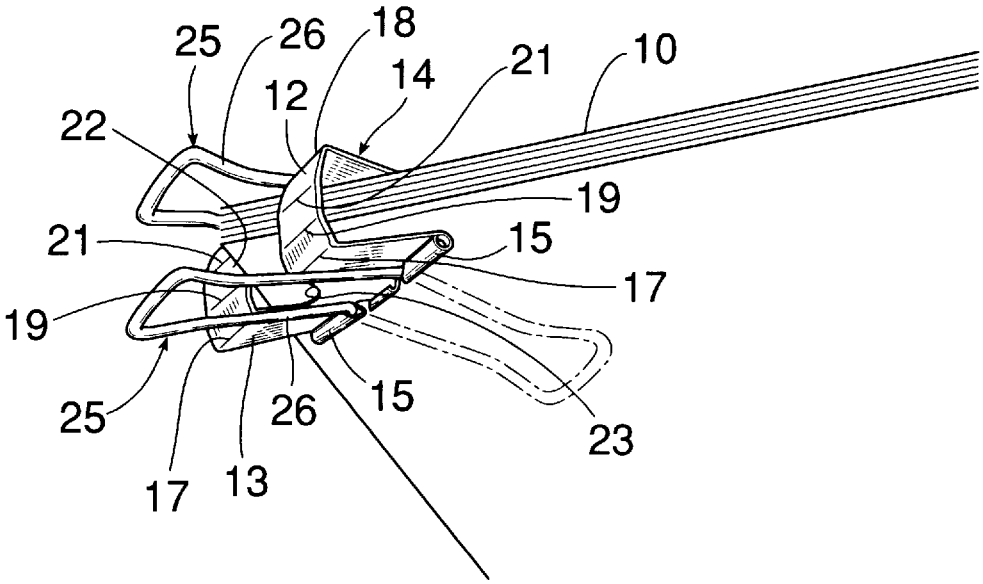
FIG. 5 is a perspective view illustrating the state where documents are clipped by the clip according to the first embodiment.

A first embodiment shown in FIGS. 1 to 5 will be described first. FIG. 1 is a perspective view illustrating a clip according to the first embodiment of the present invention; FIG. 2 is a plan view thereof; FIG. 3 is a bottom view of the clip in FIG. 1; FIG. 4 is a side view of the clip in FIG. 1; and FIG. 5 is a perspective view illustrating the state where documents are clipped by the clip according to the first embodiment.

A clip 11 is constituted by a body 14 which is formed by bending a band-like metal plate made from metal such as steel, stainless steel or the like, and finger grips 25 made from hard metal wires. In the body 14, a back portion 12 and a pair of abutment portions 13 are formed by bending. The back portion 12 has a length substantially corresponding to the maximum clipping thickness of the clip 11. The back portion 12 has such a trapezoidal shape that the apex portion is flat and projecting outside substantially at the lengthwise center of the back portion 12. The abutment portions 13 are formed by further bending the belt-like metal plate in the same direction at the lengthwise opposite ends of the back portion 12 respectively so that the abutment portions 13 elastically abut against each other at their free ends or abutting edges. On the forward end portion of each of the abutment portions 13, a pair of lock portions 15 is formed along the abutting edge of the abutment portion 13 on its widthwise opposite side portions by bending the side portions into rings, and an edge portion 16 of the abutting edge between these lock portions 15 is bent in the same manner as in a conventional clip like this type.

In order to give an elastic force to the abutment portions 13 so that the abutting edges of the abutment portions 13 abut against each other, four bent portions are provided in this first embodiment. That is, first and second bent portions 17 and 18 are formed in the borders between the lengthwise opposite ends of the back portion 12 and the respective abutment portions 13 following these opposite ends, and third and fourth bent portions 19 and 21 are formed in the back portion 12 on the borders between the flat apex portion of the back portion 12 and the inclined portions on the lengthwise opposite sides of the this apex portion which follow the apex portion up to the abutment portions 13. Respective interior angles $\alpha 1$ and $\beta 1$ formed at the bent portions 17, 18 and at the bent portions 19, 21 are set to be larger than 90°. In addition, as shown in detail in FIG. 4, the interior angle $\alpha 1$ formed at each of the first and second bent portions 17 and 18 is set to be acuter than the interior angle $\beta 1$ formed at each of the third and fourth bent portions 19 and 21 so that the elastic force due to the first and second bent portions 17 and 18 is made stronger than the elastic force due to the third and fourth bent portions 19 and 21. In addition, an opening 22 is provided substantially in a widthwise center portion of the back portion 12 of the body 14. Notches 23 following the opening 22 at the lengthwise opposite side of the opening 22 are formed in the respective abutment portions 13 substantially in their widthwise center portions on the back portion 12 side.

The opposite end portions of each of the finger grips 25 made of hard metal wire are rotatably inserted into the lock portions 15 of the abutment portions 13 respectively. Each of the finger grips 25 is constituted by a finger grip body 26 the center portion of which is bent into a substantially U-shape, and two end portions 27 formed by bending the opposite ends of this finger grip body 26 substantially at a right angle. The widthwise opposite end portions 27 of one of the finger grips 25 are inserted into the widthwise opposite side lock portions 15 of one of the abutment portions 13, while the widthwise opposite end portions 27 of the other finger grip 25 are inserted into the widthwise opposite side lock portions 15 of the other abutment portion 13. A distance between the two leg portions of each of the finger grip bodies 26 is made larger than the width of the opening 22 formed in the back portion 12, so that when the top free end sides of the finger grip bodies 26 are gripped by fingers to rotate them toward the back portion 12, the finger grip bodies 26 abut against the shoulder portions of the clip body 14 of the first and second bent portions 17 and 18 and these abutting portions are made to be fulcrums of rotation of the finger grips 25, as clearly shown in FIG. 1.

When a plurality of documents 10 as the sheet-like members are to be clipped by the clip 11 configured thus as shown in FIG. 1, the top free end sides of the finger grip bodies 26 are gripped by fingers to rotate toward the back portion 12 so that the substantially center portions of the finger grip bodies 26 abut against the shoulder corner portions of the clip body 14 formed between the back portion 12 and the abutment portions 13. Next, the top free ends of the finger grip bodies 26 are further gripped by fingers so that the abutment portions 13 of the body 14 are opened by the end portions 27 of the respective finger grip bodies 26 by the lever function with the corner portions formed between the back portion 12 and the abutment portions 13 as the fulcrums. The documents 10 may be clipped between the abutting edges of the abutment portions 13 opened thus. When the documents 10 are to be clipped at the corner part thereof, as shown in FIG. 5, the corner parts of the documents 10 are inserted into the clip 11 so that the documents 10 are clipped between the abutting edges of the abutment portions 13 while the corner parts thereof project out of the opening 22. Since the opening 22 is provided, the documents 10 can be clipped deeper at the corner parts thereof than in a conventional clip of this type. Accordingly, the abutting edges of the abutment portions 13 can always hold this clipping state surely even when the documents are thick and are turned over one by one in a clipped state. In addition, since the notches 23 following the opening 22 are formed in the abutment portions 13 at their substantially widthwise center portions on the back portion 12 side respectively, the exposed corner parts of the documents 10 can be enlarged so that one can confirm by eyes more surely the fact that the documents 10 are clipped at the corner part thereof by the clip 11.

In addition, the back portion 12 forms a trapezoid substantially, and the clip 11 as a whole forms a pentagon so that, even if the respective interior angles $\alpha 1$ and $\beta 1$ are made larger than 90°, the abutting edges of the respective abutment portions 13 can abut against each other tightly, and the elastic force may be made weaker than that in a conventional clip. Further, the interior angle $\beta 1$ formed at each of the third and fourth bent portions 19 and 21 is set to be more obtuse than the interior angle $\alpha 1$ formed at each of the first and second bent portions 17 and 18 so that the third and fourth bent portions 19 and 21 give a strong elastic force to the respective abutment portions 13 to thereby make the abutting edges thereof abut against each other tightly, while the first and second bent portions 17 and 18 give a weak elastic force to the respective abutment portions 13 to thereby make the abutting edges thereof close to each other surely. In such a manner, two stages of elastic forces due to the first and third bent portions 17 and 19 are given to one of the abutment portions 13, while two stages of elastic forces due to the second and fourth bent portions 18 and 21 are given to the other abutment portion 13. Accordingly, when the abutment portions 13 are opened, it is possible to form an enough gap to clip the sheet-like members 10 stacked up to a thickness substantially corresponding to the maximum clipping thickness limited by the lengthwise size of the back portion 12 even if these bent portions 17, 18, 19 and 21 are not opened fully. Further, since the abutting edges of the abutment portions 13 press the surface of the sheet-like members 10 with gentle elastic forces due to the first and second bent portions 17 and 18, the sheet-like members 10 can be clipped without being injured.

Further, since not only the opening 22 but also the notches 23 are provided, the elastic force acting to make the two abutment portions 13 close to each other is indeed reduced in comparison with the case where the opening 22 and the notches 23 are not provided, but the force to grip the finger grip bodies 26 by fingers to thereby open the abutment portions 13 may be reduced. On the other hand, the width of the abutting edges of the abutment portions 13 for clipping the documents 10 is the same as that in the conventional case. Accordingly, the force to clip the documents 10 indeed becomes small because of the reduction of the elastic force due to the opening 22 and the notches 23, but there is no fear that the documents 10 are detached from the clip 11 even when the documents 10 are turned up one by one, and an enough force to clip the documents 10 can be provided.

As mentioned above, even if the abutment portions 13 are opened so that the abutment portions 13 are made substantially parallel with each other in order to clip the sheet-like members 10 stacked up to a thickness substantially corresponding to the maximum clipping thickness, the respective bent portions 17, 18, 19 and 21 are opened without reaching their limitations, so that there is no fear that settling is produced in the respective bent portions. Since no settling is produced in the respective bent portions even if the abutment portions 13 are opened to their maximum, their initial elastic force can be recovered immediately when the force to open them is released. Accordingly, when the sheet-like members 10 having a stack thickness substantially corresponding to the maximum clipping thickness are removed after they are once clipped, the abutting edges of the abutment portions 13 abut against each other firmly again, and there is no fear that any gap appears between the abutting edges. Therefore, a clip without settling can be made from stainless steel which is lower in the elastic force but easier in post-processing than steel, so that such a clip can be provided at a low price. Needless to say, the body 14 of the clip 11 may be made from steel in the same manner as in a conventional case, or made from an elastic metal plate such as phosphor bronze. In this first embodiment, each of the interior angles $\alpha 1$ is set to about 95°, and each of the interior angles $\beta 1$ is set to about 115°.

Figure 6:
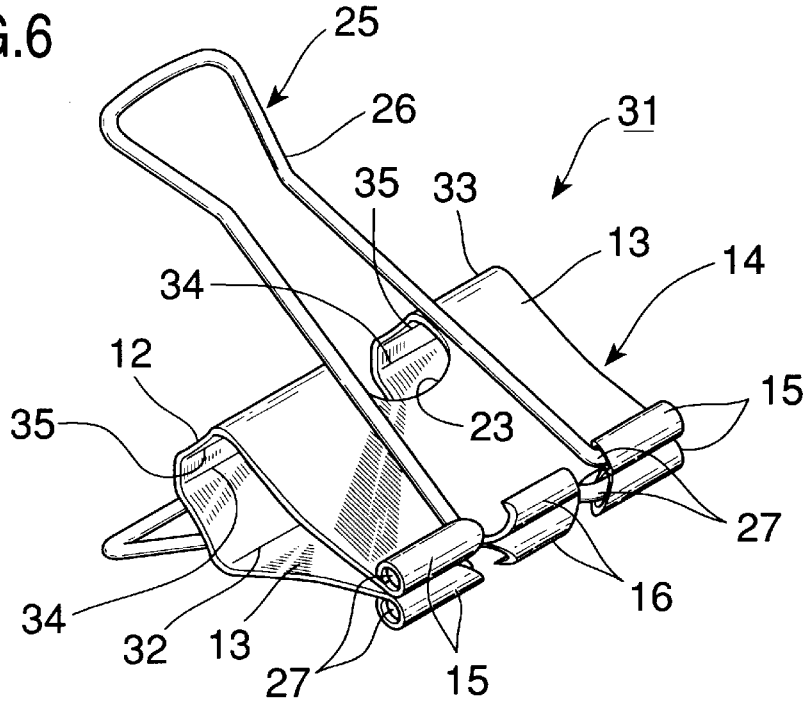
FIG. 6 is a perspective view illustrating a clip according to a second embodiment of the present invention.
Figure 7:
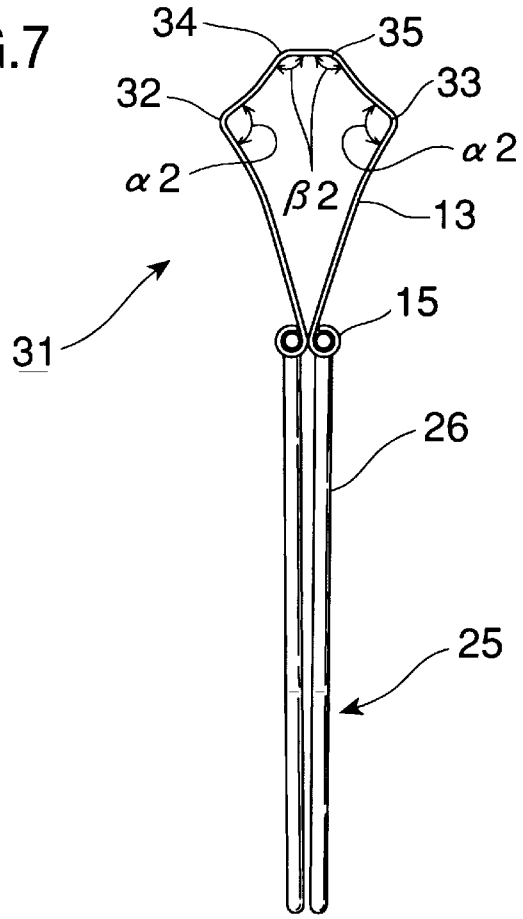
FIG. 7 is a side view of the clip according to the second embodiment.

Next, a second embodiment shown in FIGS. 6 and 7 will be described. FIG. 6 is a perspective view illustrating a clip according to the second embodiment, and FIG. 7 is a side view of the same. In a clip 31 according to this second embodiment, four bent portions are provided to give elastic forces to the respective abutment portions 13 so that the abutting edges of the abutment portions 13 abut against each other. That is, first and second bent portions 32 and 33 are formed at the borders between the lengthwise opposite ends of the back portion 12 and the respective abutment portions 13 following the back portion 12 in the same manner as in the first embodiment, and third and fourth bent portions 34 and 35 are formed in the back portion 12 at equal distances from the first and second bent portions 32 and 33 respectively. In addition, in this second embodiment, the height of the trapezoidal portion of the back portion 12 is made higher than that in the first embodiment, as shown in detail in FIG. 7.

Further, also in the second embodiment, in the same manner as in the first embodiment, each of the interior angles $\alpha 2$ formed at the first and second bent portions 32 and 33 is set to be acuter than each of the interior angles $\beta 2$ formed at the third and fourth bent portions 34 and 35. Further, the interior angle $\alpha 2$ is more obtuse than the interior angle $\alpha 1$ of the first embodiment, while the interior angle $\beta 2$ is more obtuse than the interior angle $\beta 1$ of the first embodiment. In this case, in order to prevent the interior angles $\beta 2$ from being so large as to reduce a function to give an elastic force or to produce settle, each of the portions between the abutting edge of the abutment portion 13 and the first bent portion 32, between the first bent portion 32 and the third bent portion 34, between the abutting edge of the abutment portion 13 and the second bent portion 33, and between the second bent portion 34 and the fourth bent portion 35 is bent like a circular arc projecting inward. Needless to say, though not shown, the portion between the third and fourth bent portions 34 and 35 may be curved like a circular arc.

When each of the respective interior angles $\alpha 2$ of the first and second bent portions 32 and 33 is made acute in this second embodiment, the elastic force to make the abutting edges of the respective abutment portions 13 close to each other is increased, so that the clipping force acting on the paper sheets is increased. On the other hand, when each of the respective interior angles $\beta 2$ of the third and fourth bent portions 34 and 35 are increased, the elastic force due to the third and fourth bent portions 34 and 35 at the abutting edges of the abutment portions 13 is reduced in comparison with that in the first embodiment, so that it is possible to soften the abutment of the abutting edges of the abutment portions 13 against the paper sheets. In this second embodiment, each of the interior angles $\alpha 2$ is set to about 110°, and each of the interior angles $\beta 2$ is set to about 130°.

Although a back portion is made trapezoidal and four bent portions are formed in the above-mentioned respective embodiments, the back portion may be formed like a mountain, that is, into a triangle so that three bent portions are formed at an apex portion of this triangle and two borders between the respective abutment portions and the back portion. Also in this case, the strength of the elastic force of the clip can be adjusted by adjusting the angle of the apex portion.

As is clear from the above description, according to a first aspect of the present invention, at least three bent portions are formed so as to give an elastic force to the abutment portions. Thus, the elastic force to make the abutment portions abut against each other is given by these bent portions. Accordingly, it will go well if each of the bent portions has an elastic force corresponding to about one third of the required total elastic force. Therefore, if each of the bent portions is bent in advance to generate an elastic force which is substantially a little stronger than the one third of the required total elastic force, the respective bent portions are opened still with some strength left so that there is no fear that settling is generated in the respective bent portions even if the respective abutment portions are opened up to become substantially parallel to each other. In addition, since an opening is formed in the back portion, when corners of paper sheets are clipped, the paper sheets can be clipped at a more distant position from the apexes of the corner parts of the paper sheets than that in a conventional clip so as to clip the corner parts surely and firmly. Further, since the opening is elongated into the abutment portions adjacent to the opening, the corner parts of the paper sheets exposed from this opening can be enlarged, so that it can be confirmed by eyes surely that the corner parts of the paper sheets are clipped surely by the clip.

According to a second aspect of the present invention, four bent portions are formed. Two of them are formed at a distance substantially at the lengthwise center of the back portion, and the other two are formed in the borders between the lengthwise opposite ends of the back portion and the respective abutment portions following those opposite ends of the back portion. Accordingly, the elastic force can be divided into four, so that it will go well if the respective bent portions are opened still with some strength left so that settling in the respective bent portions can be more surely prevented from being generated even if the abutment portions are opened up to become substantially parallel to each other.

According to a third aspect of the present invention, the interior angle of each of the first to fourth bent portions is made larger than a right angle, so that the elastic force to make the abutting edges of the respective abutment portions abut against each other can be reduced in comparison with that in a conventional clip, so that the abutting edges of the abutment portions can be opened easily with a weaker force.

According to a fourth aspect of the present invention, the interior angle forming each of the third and fourth bent portions is more obtuse than the interior angle forming each of the first and second bent portions, so that the abutting edges of the respective abutment portions can press down the surfaces of sheet-like members to be clipped with a soft elastic force without damaging the surface.

According to a fifth aspect of the present invention, the sides constituting a trapezoid of the back portion are bent inward at least partially, so that the interior angle of each of the bent portions can be formed to be acute. Accordingly, a desired elastic force can be obtained even if the height of the trapezoid increases.

According to a sixth aspect of the present invention, the clipping force to clip paper sheets can be set by adjusting the interior angle of each of the third and fourth bent portions, so that it is possible to provide clips having different clipping forces though they are made of metal plates with the same thickness.

According to a seventh aspect of the present invention, a pair of leg portions of each of the finger grips is opposite to each other at a distance larger than the width of the opening so that the leg portions partially abut against the shoulder corner portions of the back portion. Accordingly, the abutment portions of the clip can be opened easily and surely.

According to an eighth aspect of the present invention, the metal plate of the clip body is made from stainless steel. It is therefore possible to provide a clip which is rust-resistant, and which can be shipped as a product without surface treatment such as plating and at a low price.

What is claimed is:

1. A clip comprising:

a body made from a band-like metal plate having spring characteristics, said body including a back portion formed at a longitudinal center portion of said band-like metal plate so as to have a length in a longitudinal direction of said band-like metal plate substantially corresponding to a maximum clipping thickness of said clip, and abutment portions formed by bending said band-like metal plate in a same direction at lengthwise opposite ends of said back portion so that respective free ends of said abutment portions form abutting edges which abut against each other for clipping sheets of paper between said abutting edges of said abutment portions, said back portion being formed into a substantial trapezoid having first, second, third and fourth bent portions, said first and second bent portions being formed at borders between the lengthwise opposite ends of said back portions and said pair of abutment portions respectively, said third and fourth bent portions being formed at a distance therebetween substantially in a lengthwise center portion of said back portion, said first to fourth bent portions providing elastic forces to said abutment portions so as to make said abutting edges of said abutment portions elastically contact with each other;

a pair of finger grips for opening said abutting edges of said abutment portions, said finger grips being attached to said abutment portions respectively in a manner so that each of said finger grips is formed into a U-shape and respective free ends of said U-shape of said finger grip are rotatably inserted into lock portions formed at each of said abutting edges of said abutment portions; and an opening provided in a substantially widthwise center portion of said back portion so that corner parts of sheets of paper to be clipped can be inserted into said opening so as to project out therefrom, said opening being extended into each of said abutment portions.

2. A clip according to claim 1, wherein said metal plate is made from stainless steel.

3. A clip according to claim 1, wherein an interior angle of each of said third and fourth bent portions is obtuse.

4. A clip according to claim 1, wherein an interior angle of each of said third and fourth bent portions is more obtuse than an interior angle of each of said first and second bent portions.

5. A clip according to claim 1, wherein sides constituting said trapezoid are curved inward at least partially.

6. A clip according to claim 1, wherein a force to hold said sheets of paper is set by adjusting an interior angle of each of said third and fourth bent portions.

7. A clip according to claim 1, wherein a pair of leg portions of the U-shape of each of said finger grips is formed so as to be opposite to each other at a distance larger than a width of said opening of said back portion.

* * * * *